US008434572B2

(12) United States Patent
Stowe, II et al.

(10) Patent No.: US 8,434,572 B2
(45) Date of Patent: May 7, 2013

(54) CUTTING ELEMENTS FOR DOWNHOLE CUTTING TOOLS

(75) Inventors: Calvin J. Stowe, II, Bellaire, TX (US); Andrew D. Ponder, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 235 days.

(21) Appl. No.: 12/803,320

(22) Filed: Jun. 24, 2010

(65) Prior Publication Data

US 2011/0315455 A1 Dec. 29, 2011

(51) Int. Cl.
*E21B 10/36* (2006.01)

(52) U.S. Cl.
USPC ..... 175/430; 175/428; 407/113

(58) Field of Classification Search ..... 175/430, 175/431, 428, 401, 379, 385, 392; D15/138, D15/139; 76/108.2, 108.4; 407/113, 114
See application file for complete search history.

(56) References Cited

U.S. PATENT DOCUMENTS

| | | | |
|---|---|---|---|
| 4,259,033 A | 3/1981 | McCreery et al. | |
| 4,357,122 A | 11/1982 | Hollis, Jr. et al. | |
| 4,593,777 A | 6/1986 | Barr | |
| 4,717,290 A | 1/1988 | Reynolds et al. | |
| 4,796,709 A | 1/1989 | Lynde et al. | |
| 4,934,878 A | 6/1990 | Plutschuck et al. | |
| 4,978,260 A | 12/1990 | Lynde et al. | |
| 4,984,488 A | 1/1991 | Lunde et al. | |
| 5,027,914 A | 7/1991 | Wilson | |
| 5,058,666 A | 10/1991 | Lynde et al. | |
| 5,150,755 A | 9/1992 | Cassel et al. | |
| 5,297,630 A | 3/1994 | Lynde et al. | |
| 5,373,900 A | 12/1994 | Lynde et al. | |
| 5,443,335 A * | 8/1995 | Shimano et al. | 407/113 |

(Continued)

FOREIGN PATENT DOCUMENTS

| | | |
|---|---|---|
| EP | 0234697 A2 | 9/1987 |
| EP | 376433 A1 * | 7/1990 |
| EP | 0874127 A2 | 10/1998 |

OTHER PUBLICATIONS

Notification of Transmittal of the International Search Report and the Written Opinion of the International Searching Authority, or the Declaration, Dec. 7, 2011, pp. 1-2, PCT/US2011/039962, Korean Intellectual PropertyOffice.

(Continued)

*Primary Examiner* — David Bagnell
*Assistant Examiner* — Ronald Runyan
(74) *Attorney, Agent, or Firm* — Greenberg Traurig LLP; Anthony F. Matheny

(57) ABSTRACT

Cutting elements for downhole cutting tools comprise a top surface having a cutting surface portion and a cutting profile asymmetrically disposed across the top surface. The cutting elements comprise first and second longitudinal side surfaces and first and second lateral side surfaces, each having a respective cross-section. The cross-section of one of the longitudinal side surfaces can have one beveled portion and the cross-sections of the other longitudinal side surface and the first and second lateral side surfaces can have two beveled portions. A cutting end of a downhole cutting tool comprises two cutting elements disposed facing each another with a portion of the cutting surface portion of a first cutting element being disposed opposite the cutting profile of the second cutting element and the cutting surface portion of the second cutting element being disposed opposite the cutting profile of the first cutting element.

23 Claims, 6 Drawing Sheets

U.S. PATENT DOCUMENTS

| | | | | |
|---|---|---|---|---|
| 5,456,312 | A | 10/1995 | Lynde et al. | |
| 5,460,233 | A * | 10/1995 | Meany et al. | 175/428 |
| 5,685,671 | A | 11/1997 | Packer et al. | |
| 5,810,079 | A | 9/1998 | Lynde et al. | |
| 5,899,268 | A | 5/1999 | Lynde et al. | |
| 6,106,585 | A | 8/2000 | Packer et al. | |
| 6,155,343 | A | 12/2000 | Nazzal et al. | |
| 6,167,958 | B1 | 1/2001 | Lynde | |
| 6,422,328 | B1 | 7/2002 | Holland et al. | |
| 6,464,434 | B2 | 10/2002 | Lynde | |
| 7,363,992 | B2 | 4/2008 | Stowe et al. | |
| 7,513,319 | B2 * | 4/2009 | DeVall | 175/392 |
| 2005/0039905 | A1 | 2/2005 | Hart et al. | |
| 2005/0109546 | A1 | 5/2005 | Stowe et al. | |
| 2005/0150656 | A1 | 7/2005 | Stowe | |
| 2005/0269139 | A1 * | 12/2005 | Shen et al. | 175/430 |
| 2006/0090897 | A1 | 5/2006 | Stowe et al. | |
| 2007/0023188 | A1 | 2/2007 | Roberts et al. | |
| 2007/0201962 | A1 * | 8/2007 | Limell et al. | 408/199 |
| 2008/0006446 | A1 | 1/2008 | Stowe et al. | |
| 2008/0149393 | A1 | 6/2008 | McClain et al. | |
| 2008/0296070 | A1 * | 12/2008 | Shen et al. | 175/421 |
| 2008/0302578 | A1 * | 12/2008 | Eyre et al. | 175/430 |
| 2008/0308276 | A1 | 12/2008 | Scott | |
| 2010/0012387 | A1 | 1/2010 | Huynh et al. | |
| 2010/0084198 | A1 | 4/2010 | Durairajan et al. | |
| 2010/0108402 | A1 | 5/2010 | Ponder et al. | |
| 2011/0192653 | A1 | 8/2011 | Stowe, II | |
| 2011/0203856 | A1 | 8/2011 | Lynde | |
| 2011/0315447 | A1 | 12/2011 | Stowe, II | |
| 2011/0315448 | A1 | 12/2011 | Stowe, II | |

OTHER PUBLICATIONS

International Search Report, Dec. 7, 2011, pp. 1-5, PCT/US2011/039962, Korean Intellectual Property Office.

Written Opinion of the International Searching Authority, Dec. 7, 2011, pp. 1-3, PCT/US2011/039962, Korean Intellectual Property Office.

Notification of Transmittal of the International Search Report and the Written Opinion of the International Searching Authority, or the Declaration, Dec. 7, 2011, pp. 1-2, PCT/US2011/039971, Korean Intellectual Property Office.

International Search Report, Dec. 7, 2011, pp. 1-3, PCT/US2011/039971, Korean Intellectual Property Office.

Written Opinion of the International Searching Authority, Dec. 7, 2011, pp. 1-3, PCT/US2011/039971, Korean Intellectual Property Office.

Notification of Transmittal of the International Search Report and the Written Opinion of the International Searching Authority, or the Declaration, Dec. 7, 2011, pp. 1-2, PCT/US2011/039977, Korean Intellectual Property Office.

International Search Report, Dec. 7, 2011, pp. 1-3, PCT/US2011/039977, Korean Intellectual Property Office.

Written Opinion of the International Searching Authority, Dec. 7, 2011, pp. 1-4, PCT/US2011/039977, Korean Intellectual Property Office.

Jim McNicol, et al., First true, CT underbalanced casing exit performed, World Oil, Mar. 2005, pp. 25-26, Gulf Publishing Company, USA.

* cited by examiner

CUTTING ELEMENTS FOR DOWNHOLE CUTTING TOOLS

BACKGROUND

1. Field of Invention

The invention is directed to cutting elements or "cutters" for downhole cutting tools utilized in oil and gas wells to cut objects within the well and, in particular, to cutting elements that comprise a cutting profile disposed asymmetrically across a top surface of the cutting element to facilitate placement of the cutting elements on the cutting end of the downhole cutting tools for cutting away, among other objects, stuck tools, bridge plugs, well tubing, well casing, and the like disposed within the well.

2. Description of Art

In the drilling, completion, and workover of oil and gas wells, it is common to perform work downhole in the wellbore with a tool that has some sort of cutting profile interfacing with a downhole structure. Examples would be milling a downhole metal object with a milling tool or cutting through a tubular with a cutting or milling tool. To facilitate these operations, cutting elements are disposed on the downhole cutting tool; however, the shape, size, and design of the cutting elements can limit the locations in which the cutting elements can be placed. For example, the shape, size, and design of the cutting elements limit the ability of the tool to provide effective cutting of the object disposed below the center point of the tool.

SUMMARY OF INVENTION

Broadly, the invention is directed to cutting elements disposed on downhole cutting tools utilized in cutting away objects disposed within the well. The term "object" encompasses any physical structure that may be disposed within a well, for example, another tool that is stuck within the well, a bridge plug, the well tubing, the well casing, or the like.

In one particular embodiment, the cutting elements are disposed on blades of a downhole cutting tools that are disposed on a face of the tool. The blades are disposed on the face such that rotation of the tool causes rotation of the blades. One or more of the blades include a front side surface that has disposed on it one or more cutting elements, a back side surface, an outer end, an inner end, and at least one beveled portion disposed on the front side surface toward the inner end. The back side surface generally does not include any cutting elements. The presence of the cutting element on the beveled portion allows the blade to be position such that the center point of the face of the downhole cutting tool is covered by a cutting element. In this arrangement, rotation of the downhole cutting tool provides for the portion of the object disposed directly below the center point of the face of the downhole cutting tool to be cut away.

In one specific embodiment, the cutting elements comprise a top surface having an asymmetrically disposed cutting profile. The placement of the cutting profile asymmetrically on the top surface provides areas on the top surface that are not raised. In one particular embodiment, the placement of the cutting profile asymmetrically provides at least one cutting surface portion or area that is larger than any other cutting surface portions or areas, if any others are present.

In other specific embodiments, the cutting elements comprise various shapes and designs to facilitate placement of the cutting elements on the face or other structure carrying the cutting elements on the cutting end of the downhole cutting tool and to facilitate cutting the object in the wellbore.

While the invention will be described in connection with the preferred embodiments, it will be understood that it is not intended to limit the invention to these embodiments. On the contrary, it is intended to cover all alternatives, modifications, and equivalents, as may be included within the spirit and scope of the invention as defined by the appended claims.

DETAILED DESCRIPTION OF INVENTION

Figure 1:
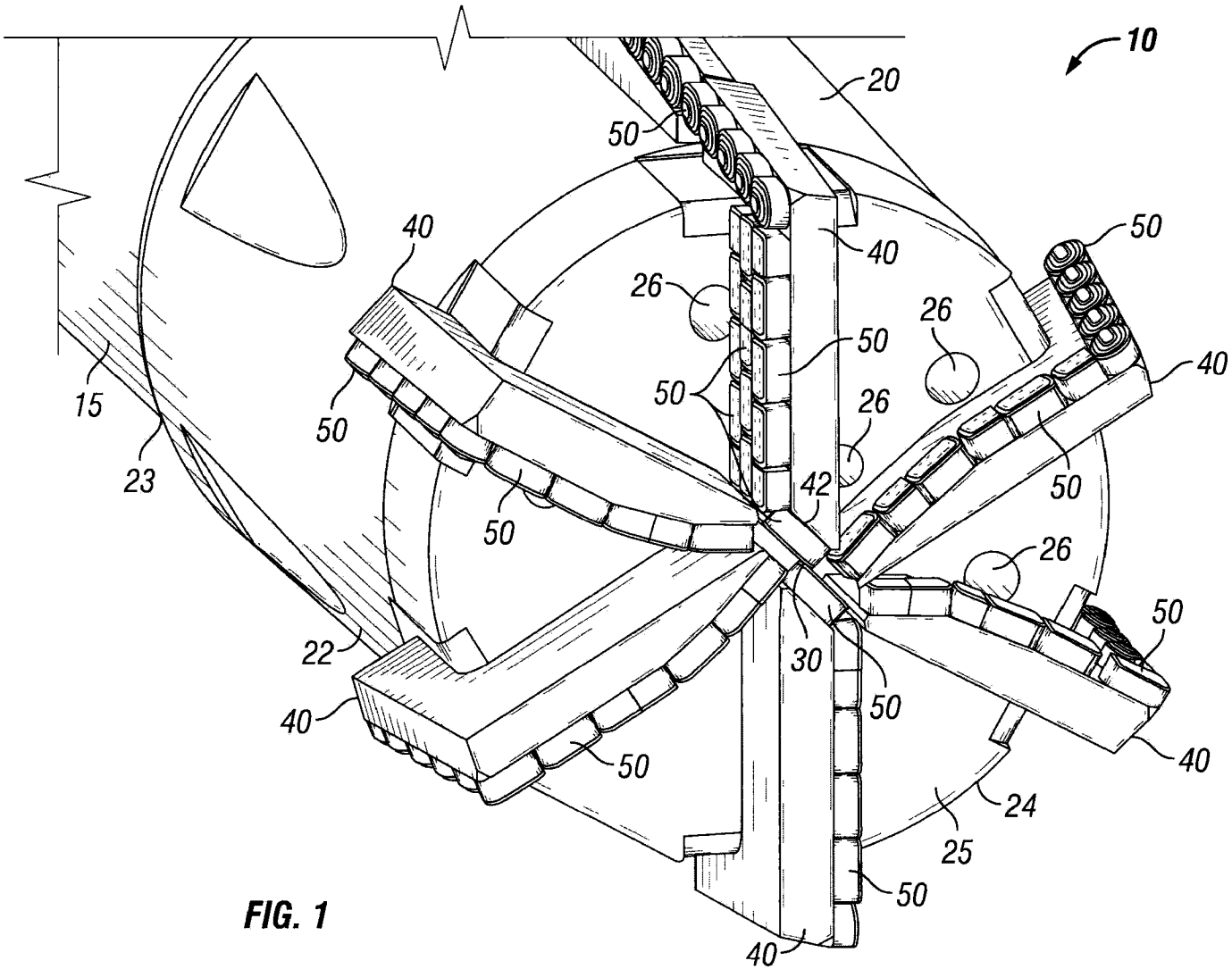
FIG. 1 is a perspective view of one specific embodiment of a downhole cutting tool having cutting elements such as those disclosed herein.

Referring now to FIG. 1, downhole cutting tool 10 comprises blade mill 20 having body or housing 22 adapted at upper end 23 to be connected to drill or work string 15, cutting end 24 having face 25, drilling fluid ports 26 through which drilling or cutting fluid flows to facilitate cutting by blade mill 20, and, as shown in the specific embodiment in the Figures, six blades 40. Affixed to a front or forward face of each of the six blades 40 are one or more cutting elements 50. In addition, as shown in FIG. 1, two cutting elements 50 are disposed on beveled portions 42 of blades 40 facing toward each other across center point 30 of face 25 so that the portion of the object below center point 30 can be cut by cutting elements 50. And, as further shown in FIG. 1, these two cutting elements 50 disposed on beveled portions 42 overlap one another to facilitate cutting the portion of the object below the center point This overlapping increases the strength and durability of these two cutting elements 50 and decreases the probability that any uncut portion of the object remains that could be forced between the two cutting elements 50 causing the two cutting elements 50 to wedge apart and possibly break. It is to be understood that although the cutting elements 50 are shown in FIG. 1 as having various shapes, sizes, and designs, any one of the cutting elements 50 may have one or more of the features discussed below.

Figure 2:
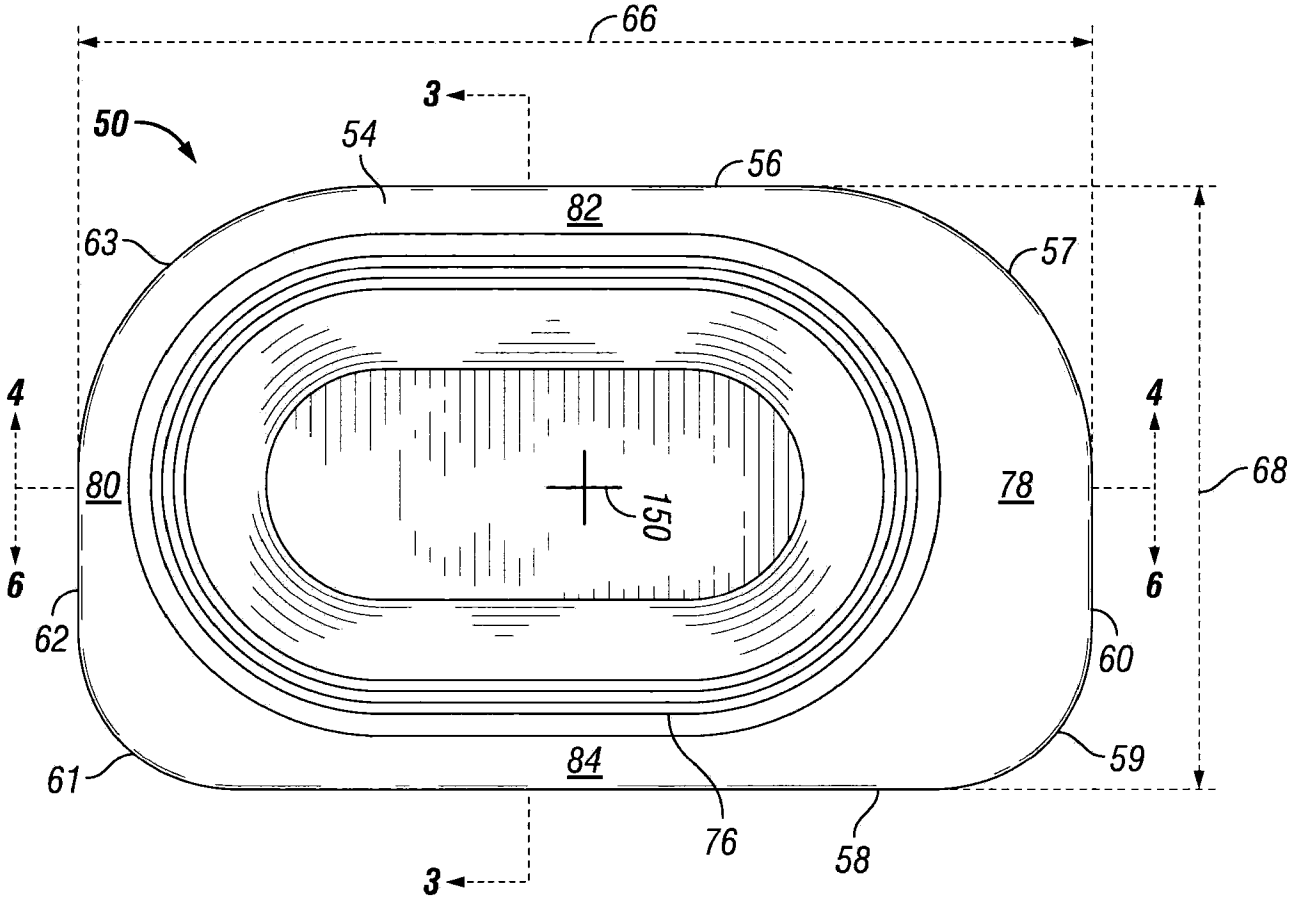
FIG. 2 is a top view of one specific embodiment of a cutting element disclosed herein.
Figure 3:
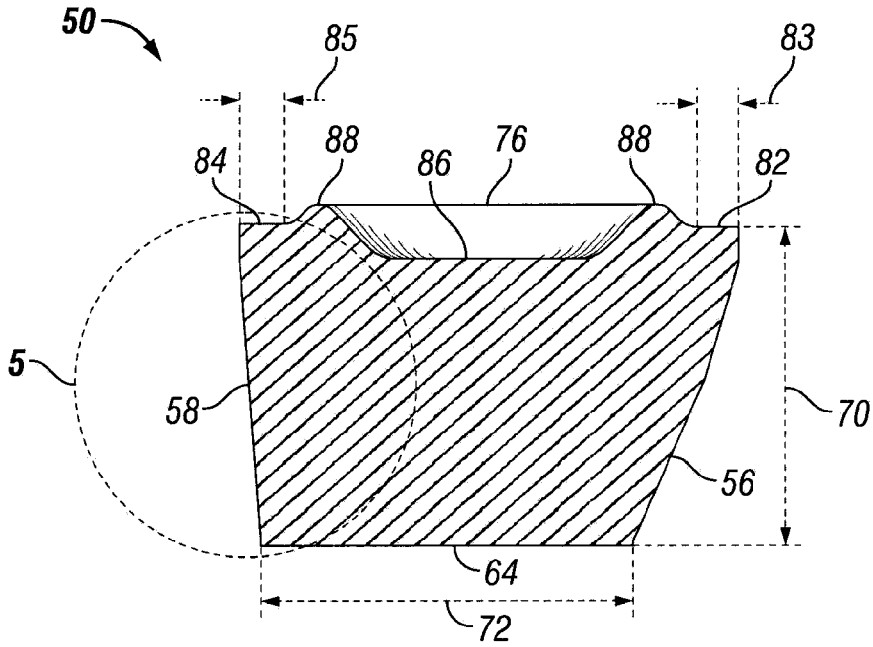
FIG. 3 is a cross-sectional view of the cutting element of FIG. 2 taken along line 3-3.

Referring now to FIGS. 2-12, cutting element 50 comprises top surface or cutting face 54, first longitudinal side surface 56, second longitudinal side surface 58, first lateral side surface 60, second lateral side surface 62, and bottom surface 64 (FIG. 3). Cutting element 50 includes a central longitudinal axis 150 (FIG. 2). First and second lateral side surfaces 60, 62 define top surface length 66 (shown in FIG. 2), i.e., the length of cutting element 50 along top surface 54 between first and second lateral side surfaces 60, 62. Length 66 can be any distance/measurement desired or necessary to facilitate placement of cutting element 50 on cutting end 24 of a downhole cutting tool. For example, length 66 can be in the range from 0.25 inches to 1 inch. In one specific embodiment, length 66 is 0.625 inches.

First and second lateral side surfaces 60, 62 also define bottom surface length 74 (shown in FIG. 4), i.e., the length of cutting element 50 along bottom surface 64 between first and second lateral side surfaces 60, 62. Length 74 can be any distance/measurement desired or necessary to facilitate placement of cutting element 50 on cutting end 24 of a downhole cutting tool. For example, length 74 can be in the range from 0.25 inches to 1 inch. In one specific embodiment, length 74 is 0.473 inches.

First and second longitudinal side surfaces 56, 58 define top surface width 68 (shown in FIG. 2), i.e., the width of cutting element 50 along top surface 54 between first and second longitudinal side surfaces 56, 58. Width 68 can be any distance/measurement desired or necessary to facilitate placement of cutting element 50 on cutting end 24 of a downhole cutting tool. For example, width 68 can be can be in the range from 0.25 inches to 1 inch. In one specific embodiment, width 68 is 0.375 inches.

First and second longitudinal side surfaces 56, 58 define bottom surface width 72 (shown in FIG. 3), i.e., the width of cutting element 50 along bottom surface 64 between first and second longitudinal side surfaces 56, 58. Width 72 can be any distance/measurement desired or necessary to facilitate placement of cutting element 50 on cutting end 24 of a downhole cutting tool. For example, width 72 can be can be in the range from 0.25 inches to 1 inch. In one specific embodiment, width 72 is 0.281 inches.

Top surface 54 and bottom surface 64 define height 70 (shown in FIG. 3). Height 70 can be any distance/measurement desired or necessary to facilitate placement of cutting element 50 on cutting end 24 of a downhole cutting tool. For example, height 70 can be can be in the range from 0.1 inches to 1 inch. In one specific embodiment, height 70 is 0.250 inches.

As shown in the embodiment of the Figures, cutting element 50 comprises first radial surface 57 disposed between first longitudinal side surface 56 and first lateral side surface 60, second radial surface 59 disposed between first lateral side surface 60 and second longitudinal side surface 58, third radial surface 61 disposed between second longitudinal side surface 58 and second lateral side surface 62, and fourth radial surface 63 disposed between second lateral side surface 62 and first longitudinal side surface 56. Each of radial surfaces 57, 59, 61, 63 comprise a radius of curvature. Each of the radii of curvature of radial surfaces 57, 59, 61, 63 can be any distance/measurement desired or necessary to facilitate placement of cutting element 50 on cutting end 24 of a downhole cutting tool. For example, the radii of curvature of radial surfaces 57, 59, 61, 63 can be in the range from 0.010 inches to 1 inch. In the particular embodiment of FIGS. 2-8, the radius of curvature of radial surface 57 is equal to the radius of curvature of radial surface 63, the radius of curvature of radial surface 59 is equal to the radius of curvature of radial surface 61, and the radii of curvature of radial surfaces 57, 63 are not equal to the radii of curvature of radial surfaces 59, 61. In one specific embodiment, the radius of curvature of radial surface 57 is 0.188 inches, radius of curvature of radial surface 59 is 0.090 inches, radius of curvature of radial surface 61 is 0.090 inches, and radius of curvature of radial surface 63 is 0.188 inches.

Figure 4:
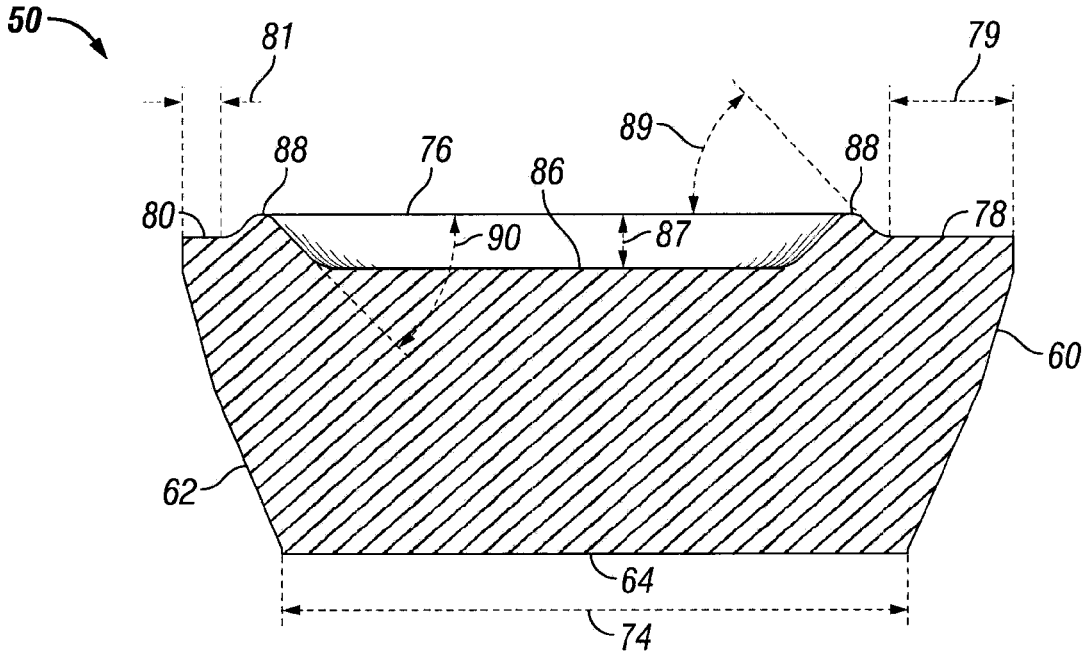
FIG. 4 is a cross-sectional view of the cutting element of FIG. 2 taken along line 4-4.

As best illustrated in FIGS. 3-4, cutting profile 76 comprises recess 86 and cutting edge 88 which define depth 87 (shown in FIG. 4) of cutting profile 76. Depth 87 can be any distance/measurement desired or necessary to facilitate cutting an object (not shown) disposed in a wellbore. For example, depth 87 can be can be in the range from 0.010 inches to 1 inch. In one specific embodiment, depth 87 is 0.040 inches.

Cutting edge 88 is shown as having an oval shape, however, it is to be understood that cutting edge 88 can have any shape desired or necessary to facilitate cutting an object (not shown) disposed in a wellbore, e.g., rectangular, square, circular, egg-shaped, and the like. As shown in the Figures, cutting edge 88 is defined by two angles 89, 90. Angles 89, 90 can be set at any degree desired or necessary to facilitate cutting the object. For example, angles 89, 90 can be in the range from 15 degrees to 75 degrees. In one specific embodiment, angles 89, 90 are 45 degrees.

Cutting profile 76 is asymmetrically disposed on top surface or cutting face 54 of cutting element 50. As used herein, the term "asymmetrically" means cutting profile 76 is not centered on top surface 54. Thus, one or more portions or areas of top surface 54 disposed around the outside or circumference of cutting profile 76 is not equal to any other such portions. These portions are referred to herein as "cutting surface portions" of top surface or cutting face 54. The cutting surface portion(s) facilitate the overlapping of two cutting elements 50 such as shown in FIG. 1 (discussed above) and FIGS. 9-12 (discussed in greater detail below).

As shown in FIGS. 2-8, this embodiment of cutting element 50 comprises numerous cutting surface portions, four of which are defined by the longitudinal and lateral edges of cutting edge 88 and first and second longitudinal side surfaces 56, 58 and first and second lateral side surfaces 60, 62. Cutting surface portion 78 is defined by first lateral side surface 60 and a first lateral edge of cutting edge 88. Cutting surface portion 80 is defined by second lateral side surface 62 and a second lateral edge of cutting edge 88. As used herein, "lateral edge" means the portion of cutting edge 88 that is closest to first lateral side surface 60 or second lateral side surface 62.

Cutting surface portion 82 is defined by first longitudinal side surface 56 and a first longitudinal edge of cutting edge 88. Cutting surface portion 84 is defined by second longitudinal side surface 58 and a second longitudinal edge of cutting edge 88. As used herein, "longitudinal edge" means the portion of cutting edge 88 that is closest to first longitudinal side surface 56 or second longitudinal side surface 58.

Each of cutting surface portions 78, 80, 82, 84 comprise a distance/measurement. Distance 79 (FIG. 4) is defined as the measurement from cutting edge 88 to first lateral side surface 60. Distance 81 (FIG. 4) is defined as the measurement from cutting edge 88 to second lateral side surface 62. Distance 83 (FIG. 3) is defined as the measurement from cutting edge 88 to first longitudinal side surface 56. Distance 85 (FIG. 3) is defined as the measurement from cutting edge 88 to second longitudinal side surface 58. As shown in the drawings, distance 79 is greater than distances 81, 83, and 85 so that cutting surface portion 78 has a larger area compared to cutting surface portions 80, 82, and 84. However, it is to be understood, that distances 79, 81, 83, and 85 can be modified in any way desired or necessary to facilitate cutting the object in the wellbore. For example, distance 79 can be in the range from 0.080 inches to 0.120 inches, distance 81 can be in the range from 0.01 inches to 0.090 inches, distance 83 can be in the range from 0.01 inches to 0.090 inches, and distance 85 can be in the range from 0.01 inches to 0.090 inches. In one particular embodiment, distance 79 is at least twice as long as distance 81. In another embodiment, distance 79 is 0.102 inches, distance 81 is 0.040 inches, distance 83 is 0.040 inches, and distance 85 is 0.040 inches.

Figure 5:
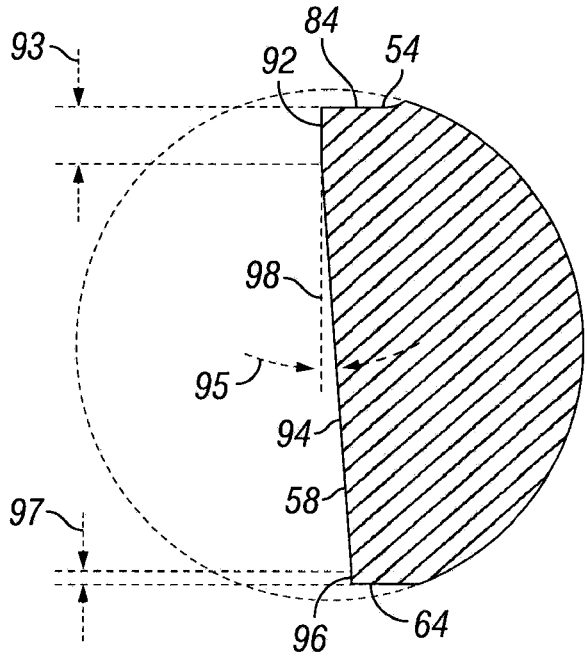
FIG. 5 is an enlarged cross-section view of the portion of the cutting element circled in FIG. 3.

As illustrated in FIG. 5, a cross-section view of second longitudinal side surface 58 shows that second longitudinal side surface 58 comprises bevel portion 94 disposed at angle 95 relative to axis 98. Axis 98 is disposed perpendicular to top surface 54. Angle 95 can be in the range from 3 degrees to 12 degrees. In a specific embodiment angle 95 is 5 degrees.

In addition, cross-section view of second longitudinal side surface 58 shows that second longitudinal side surface 58 includes upper portion 92 that is parallel to axis 98 and lower portion 96 that is parallel to axis 98. Length 93 of upper portion 92 can be any distance/measurement desired or necessary to facilitate placement of cutting element 50 on cutting end 24 of a downhole cutting tool. For example, length 93 can be in the range from 0.01 inches to 0.035 inches. In a specific embodiment, length 93 of upper portion 92 is 0.025 inches.

Length 97 of lower portion 96 can be any distance/measurement desired or necessary to facilitate placement of cutting element 50 on cutting end 24 of a downhole cutting tool. For example, length 97 can be in the range from 0.001 inches to 0.010 inches. In a specific embodiment, length 97 of lower portion 96 is 0.005 inches.

Figure 6:
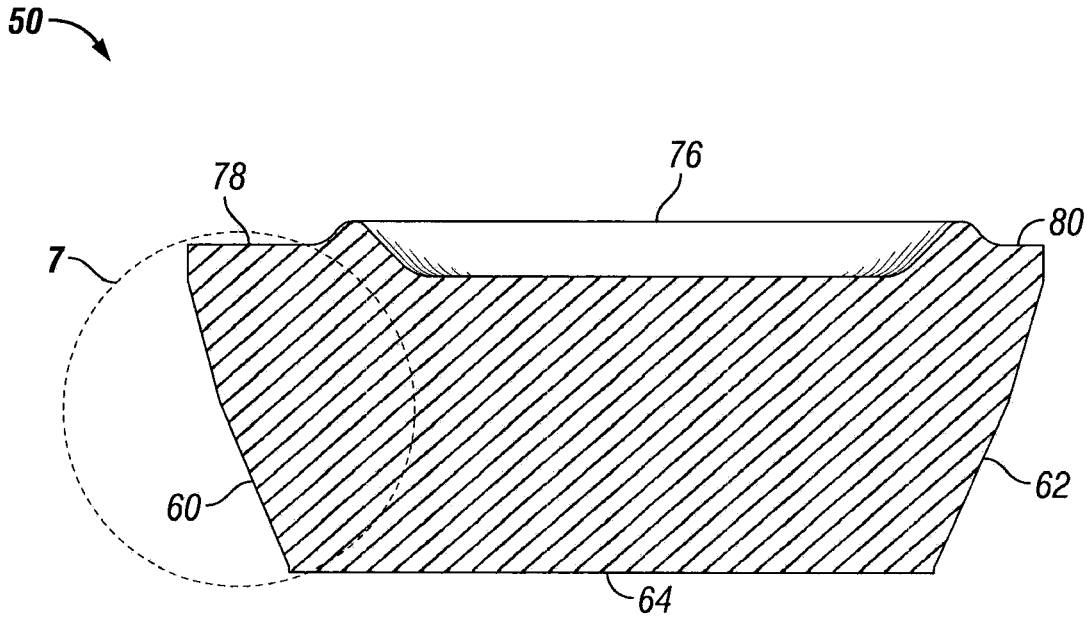
FIG. 6 is a cross-sectional view of the embodiment of the cutting element of FIG. 2 taken along line 6-6.
Figure 7:
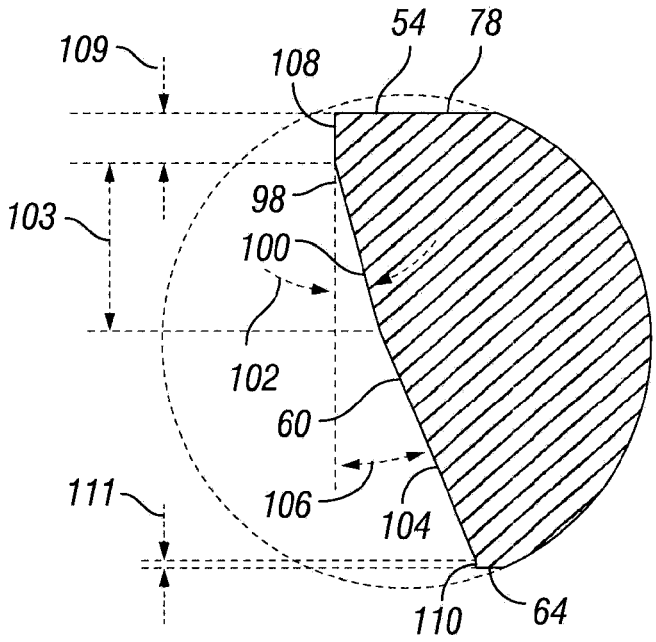
FIG. 7 is an enlarged cross-section view of the portion of the cutting element circled in FIG. 6.
Figure 8:
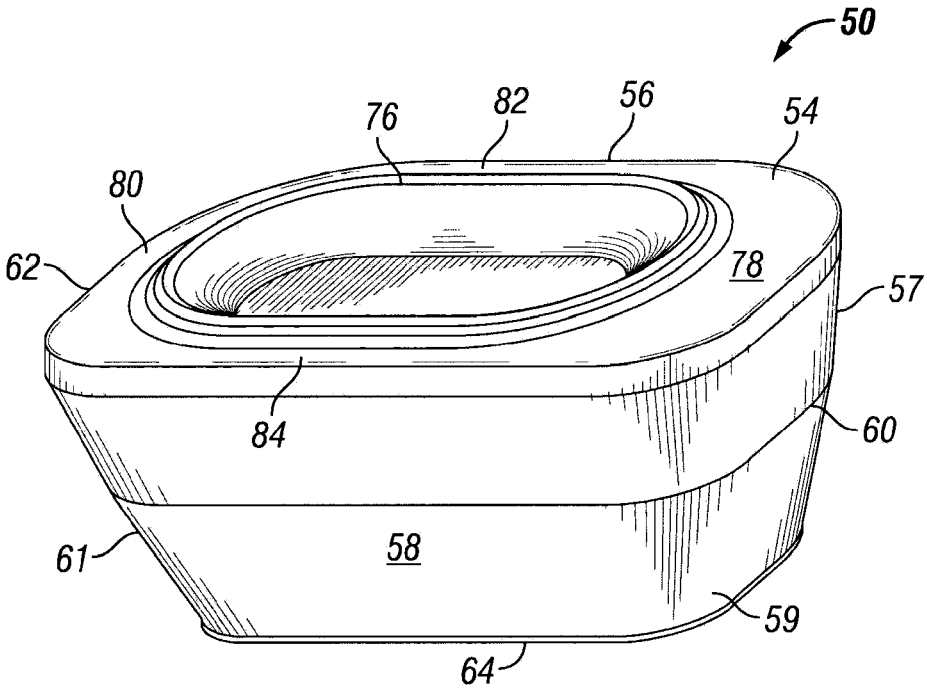
FIG. 8 is a perspective view of the embodiment of the cutting element of FIGS. 2-7.

As shown in FIGS. 6-7, first lateral side surface 60 comprises upper beveled portion 100 disposed at angle 102 relative to axis 98, and lower beveled portion 104 disposed at angle 106 relative to axis 98. In the embodiment shown in the Figures, upper beveled portion 100 is disposed adjacent to lower beveled portion 104.

Length 103 of upper beveled portion 100 can be any distance/measurement desired or necessary to facilitate placement of cutting element 50 on cutting end 24 of a downhole cutting tool. For example, length 103 can be can be in the range from 0.025 inches to 1 inch. In a particular embodiment, length 103 is 0.085 inches.

Angles 102, 106 can be any angle desired or necessary to facilitate placement of cutting element 50 on cutting end 24 of a downhole cutting tool. For example, angle 102 can be in the range from 10 degrees to 20 degrees and angle 106 can be in the range from 20 degrees to 30 degrees. In a specific embodiment angle 102 is 15 degrees and angle 106 is 24 degrees.

In addition, cross-section view of first lateral side surface 60 shows that first lateral side surface 60 includes upper portion 108 that is parallel to axis 98 and lower portion 110 that is parallel to axis 98. Length 109 of upper portion 108 can be any distance/measurement desired or necessary to facilitate placement of cutting element 50 on cutting end 24 of a downhole cutting tool. For example, length 109 can be in the range from 0.01 inches to 0.035 inches. In a specific embodiment, length 109 of upper portion 108 is 0.025 inches.

Length 111 of lower portion 110 can be any distance/measurement desired or necessary to facilitate placement of cutting element 50 on cutting end 24 of a downhole cutting tool. For example, length 111 can be in the range from 0.001 inches to 0.010 inches. In a specific embodiment, length 111 of lower portion 110 is 0.005 inches.

Although not shown in detail, it is to be understood that in the embodiment shown in FIGS. 2-12, the cross-section of second lateral side surface 62 is the same as the cross-section of first lateral side surface 60. In other words, the cross-section of second lateral side surface 62 has the same beveled portions, parallel portions, and angles as first lateral side surface 60. It is also to be understood that these cross-sections are not required to be identical.

Further, it is to be understood that the cross-section of first longitudinal side surface 56 can include beveled portions, parallel portions, and angles. In the specific embodiment shown in the Figures, first longitudinal side surface 56 includes beveled portions, parallel portions, and angles that coincide with, and are identical to, beveled portions, 100, 104, parallel portions 108, 110, and angles 102, 106 of first and second lateral side surfaces 60, 62. It is also to be understood that the cross-section of first longitudinal side surface 56 is not required to be identical to the cross-sections of either first or second lateral side surfaces 60, 62.

In one particular embodiment of the cutting element of FIGS. 2-8, length 66 is 0.625 inches, width 68 is 0.375 inches, length 74 is 0.473 inches, width 72 is 0.281 inches, height 70 is 0.25 inches, radii of curvature 57, 63 are 0.188 inches, radii of curvature 59, 61 are 0.09 inches, length 93 of upper portion 92 is 0.025 inches, bevel angle 95 is 5 degrees, length 97 of lower portion 96 is 0.005 inches, length 109 of upper portion 108 is 0.025 inches, bevel angle 102 is 15 degrees, length 103 of bevel portion 100 is 0.085 inches, bevel angle 106 is 24 degrees, length 111 of lower portion 110 is 0.005 inches, depth 87 is 0.040 inches, and angles 89, 90 are 45 degrees.

Figure 9:
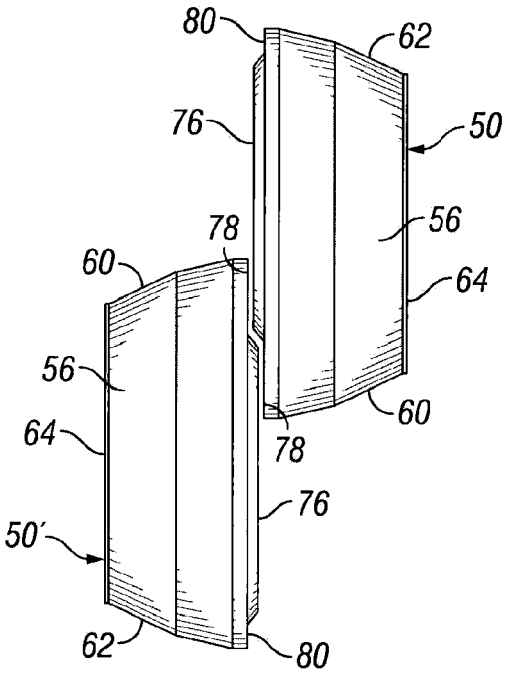
FIG. 9 is a side view of two cutting elements of FIGS. 2-7 shown disposed parallel and facing each other.
Figure 10:
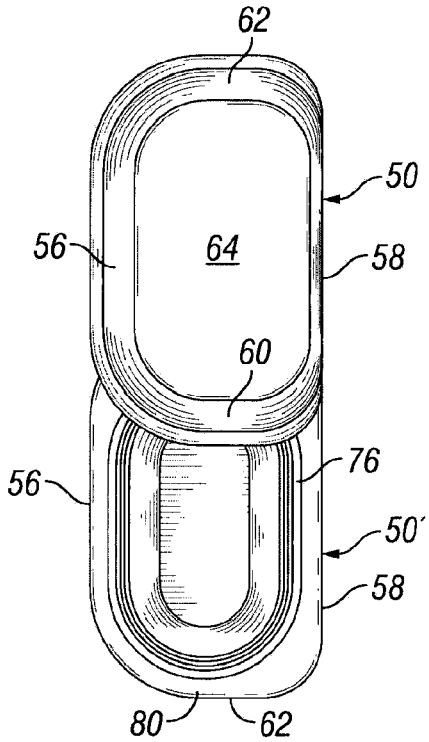
FIG. 10 is a rotated view of the two cutting elements of FIG. 9 shown disposed parallel and facing each other.

Referring with particular reference to FIGS. 9-10, but as also illustrated in FIG. 1, two cutting elements 50, 50' are shown in relation to one another as they can be arranged on cutting end 24 of downhole cutting tool 20, such as on two blades 40 as shown in FIG. 1 or directly on a continuous face, such as face 25 of cutting end 24. As illustrated, the top surfaces or cutting faces 54 of the two cutting elements 50, 50' are disposed facing each other with cutting surface portion 78 of cutting element 50 being disposed opposite cutting profile 76 of cutting element 50', and cutting surface portion 78 of cutting element 50' being disposed opposite cutting profile 76 of cutting element 50. As shown in FIGS. 9-10, cutting elements 50, 50' are disposed parallel to each other with second longitudinal side surfaces 58 of cutting elements 50, 50' aligned with each other, and first longitudinal side surfaces 56 of cutting elements 50, 50' aligned with each other.

Figure 11:
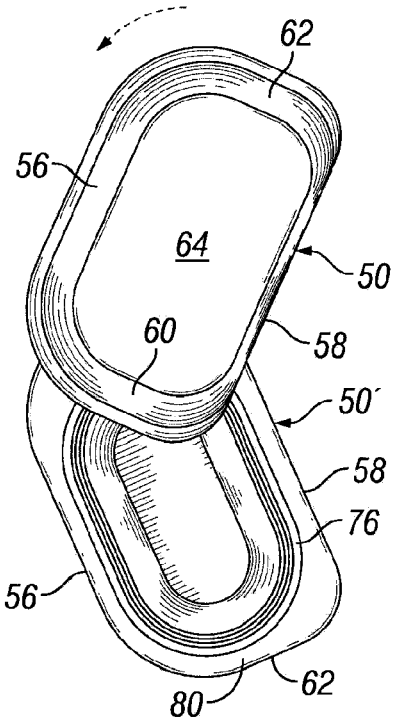
FIG. 11 is a view of the embodiment of the cutting elements of FIGS. 2-7 shown disposed facing each other at a non-parallel angle.
Figure 12:
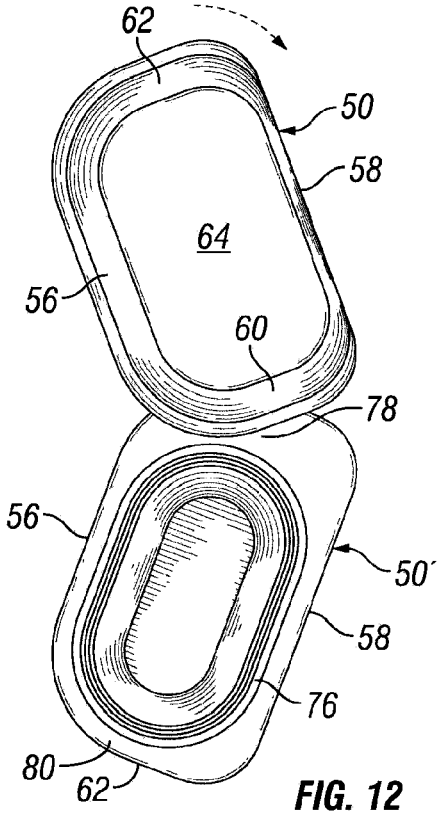
FIG. 12 is a view of the embodiment of the cutting elements of FIGS. 2-7 shown disposed facing each other at a non-parallel angle different from the non-parallel angle in FIG. 11.

Referring now to FIGS. 11-12, cutting elements 50, 50' are disposed at a non-parallel angle with respect to each other. In the arrangement of FIG. 11, second longitudinal side surfaces 58 of cutting elements 50, 50' define an acute angle. In this orientation cutting elements 50, 50' can be disposed on the cutting end 24 such that rotation of the tool 10 allows cutting elements 50, 50' to contact the object in the well toward the ends of cutting profiles 76 toward lateral ends 60.

In the arrangement of FIG. 12, first longitudinal side surfaces 56 of cutting elements 50, 50' define an acute angle. In this orientation, cutting elements 50, 50' can be disposed on the cutting end 24 such that rotation of the tool 10 allows cutting elements 50, 50' to contact the object in the well toward the ends of cutting profiles 76 toward lateral ends 62.

It is to be understood that the invention is not limited to the exact details of construction, operation, exact materials, or embodiments shown and described, as modifications and equivalents will be apparent to one skilled in the art. For example, the cutting elements are shown in FIG. 1 as being used on a mill blade, however, the cutting elements may be included on any type of downhole cutting tool such as drill bits and non-blade mills and may be included directly on the face of the cutting end of the tool. Moreover, the angles of the bevel portions of the longitudinal and lateral side surfaces of the cutting elements can be modified as desired or necessary to facilitate placement of the cutting elements on the face or other structure carrying the cutting elements on the cutting end of the downhole cutting tool or to facilitate cutting the object in the wellbore. Likewise, the shapes of the cutting elements can be modified as desired or necessary to facilitate placement of the cutting elements on the face or other structure carrying the cutting elements on the cutting end of the downhole cutting tool. And, the lengths, widths, and heights of the longitudinal and lateral side surfaces can also be modified as desired or necessary to facilitate placement of the cutting elements on the face or other structure carrying the cutting elements on the cutting end of the downhole cutting tool or to facilitate cutting the object in the wellbore. In addition, the height does not need to be consistent or constant across either the length or width of the top surface or the length or width of the bottom surface. Nor are is there any requirement that the cutting elements include any radial surfaces, or that if two or more radial surfaces are present, that any one radius of curvature is equal to any other radius of curvature.

Further, the cutting profile can be modified as desired or necessary to facilitate cutting the object in the wellbore. Moreover, the size and shape of the cutting surface portions on the top surface of the cutting elements can be modified as desired or necessary to facilitate placement of the cutting elements on the face or other structure carrying the cutting elements on the cutting end of the downhole cutting tool or to facilitate cutting the object in the wellbore. And, although the cutting elements are shown in FIG. 1 as being disposed perpendicular to the blades, i.e., at an angle of 90 degrees relative to the blade, one or more of the cutting elements may be tilted downwardly or upwardly at an angle other than 90 degrees relative to the blades. Therefore, it is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims.

What is claimed is:

1. A cutting element for inclusion on a downhole cutting tool for cutting an object disposed in a wellbore, the cutting element comprising:

a body comprising a top surface, a bottom surface disposed opposite the top surface, a first longitudinal side surface, a second longitudinal side surface disposed opposite the first longitudinal side surface, a first lateral side surface, a second lateral side surface disposed opposite the first lateral side surface, and a central longitudinal axis defined by the top surface and the bottom surface; and a cutting profile, the cutting profile disposed asymmetrically along the top surface relative to the longitudinal axis, wherein a cross-section of the first longitudinal side surface comprises a first beveled portion disposed adjacent a second beveled portion.

2. The cutting element of claim 1, wherein the asymmetrically disposed cutting profile comprises a first cutting surface portion disposed between a first lateral edge of the cutting profile and the first lateral side surface.

3. The cutting element of claim 2, wherein the asymmetrically disposed cutting profile further comprises a second cutting surface portion disposed between a second lateral edge of the cutting profile and the second lateral side surface, and wherein the first cutting surface portion comprises a first distance between the first lateral edge and the first lateral side surface that is at least twice as long as a second distance between the second lateral edge and the second lateral side surface.

4. The cutting element of claim 1, wherein a cross-section of the first lateral side surface comprises third and fourth beveled portions, wherein a cross-section of the second lateral side surface comprises fifth and sixth beveled portions, wherein the first beveled portion of the first longitudinal side surface cross-section is disposed at an angle relative to an axis disposed perpendicular to the top surface that is identical to respective angles of the third and fifth beveled portions of the first and second lateral side surfaces relative to the axis disposed perpendicular to the top surface, and wherein the second beveled portion of the first longitudinal side surface cross-section is disposed at an angle relative to the axis disposed perpendicular to the top surface that is identical to respective angles of the fourth and sixth beveled portions of the first and second lateral side surfaces relative to the axis of the disposed perpendicular to the top surface.

5. The cutting element of claim 4, wherein a cross-section of the second longitudinal side surface comprises a seventh beveled portion.

6. The cutting element of claim 1, wherein the first and second longitudinal side surfaces provide a first longitudinal width across the top surface and a second longitudinal width across the bottom surface, the first longitudinal width being greater than the longitudinal second width.

7. The cutting element of claim 1, wherein the first and second lateral side surfaces provide a first lateral width across the top surface and a second lateral width across the bottom surface, the first lateral width being greater than the lateral second width.

8. The cutting element of claim 1, further comprising a first radial surface disposed between the first longitudinal side surface and the first lateral side surface, the first radial surface comprising a first radius of curvature, a second radial surface disposed between the first lateral side surface and the second longitudinal side surface, the second radial surface comprising a second radius of curvature, a third radial surface disposed between the second longitudinal side surface and the second lateral side surface, the third radial surface comprising a third radius of curvature, and a fourth radial surface disposed between the second lateral side surface and the first longitudinal side surface, the fourth radial surface comprising a fourth radius of curvature.

9. The cutting element of claim 8, wherein the first radius of curvature is equal to the fourth radius of curvature, the second radius of curvature is equal to the third radius of curvature, and the first and fourth radii of curvature are not equal to the second and third radii of curvature.

10. A downhole cutting tool for use in a well, the well having a surface location and a downhole location, the downhole cutting tool comprising:

a body having a first end for connection with a rotating component of a drill string; and a cutting end for rotation in unison with the body, the cutting end comprising a first cutting element and a second cutting element, each of the first and second cutting elements comprising a longitudinal axis and a cutting profile disposed asymmetrically relative to the longitudinal axis along a cutting face of the first and second cutting elements, the asymmetrically disposed cutting profile providing a first cutting surface portion disposed between a first lateral edge of the cutting profile and the first lateral side surface and a second cutting surface portion disposed between a second lateral edge of the cutting profile and the second lateral side surface, wherein the first cutting surface portion comprises a first distance between the first lateral edge and the first lateral side surface that is at least twice as long as a second distance between the second lateral edge and the second lateral side surface, and wherein the cutting face of the first cutting element is arranged facing the cutting face of the second cutting element, the first cutting surface portion of the first cutting element being disposed opposite the cutting profile of the second cutting element and the first cutting surface portion of the second cutting element being disposed opposite the cutting profile of the first cutting element.

11. The downhole cutting tool of claim 10, wherein the first cutting element is disposed parallel to the second cutting element.

12. The downhole cutting tool of claim 10, wherein the first cutting element is disposed at a non-parallel angle relative to the second cutting element.

13. The downhole cutting tool of claim 12, wherein the first and second cutting elements further comprise bottom surfaces disposed opposite the cutting faces, first longitudinal side surfaces, second longitudinal side surfaces disposed opposite the first longitudinal side surfaces, first lateral side surfaces, and second lateral side surfaces disposed opposite the first lateral side surfaces to provide cutting element bodies, wherein a cross section of each of the first longitudinal side surfaces of the first and second cutting elements comprise first and second beveled portions disposed adjacent each other, and wherein the non-parallel angle comprises an acute angle defined by the first longitudinal side surfaces of the first and second cutting elements.

14. The downhole cutting tool of claim 13, wherein the first beveled portions of the first longitudinal side surface cross sections comprise first beveled angles of 15 degrees relative to an axis disposed perpendicular to the cutting face, and wherein the second beveled portions of the first longitudinal side surface cross sections comprise second beveled angles of 24 degrees relative to the axis disposed perpendicular to the cutting face.

15. The downhole cutting tool of claim 12, wherein the first beveled portions of the first longitudinal side surface cross sections comprise first beveled angles in the range from 10 degrees to 20 degrees relative to an axis disposed perpendicular to the cutting face, and wherein the second beveled portions of the first longitudinal side surface cross sections comprise second beveled angles in the range from 20 degrees to 30 degrees relative to the axis disposed perpendicular to the cutting face.

16. The downhole cutting tool of claim 12, wherein the first and second cutting elements further comprise bottom surfaces disposed opposite the cutting faces, first longitudinal side surfaces, second longitudinal side surfaces disposed opposite the first longitudinal side surfaces, first lateral side surfaces, and second lateral side surfaces disposed opposite the first lateral side surfaces to provide cutting element bodies, wherein a cross section of each of the second longitudinal side surfaces of the first and second cutting element comprise a beveled portion, and wherein the non-parallel angle comprises an acute angle defined by the second longitudinal side surfaces of the first and second cutting elements.

17. The downhole cutting tool of claim 16, wherein the beveled portions of the second longitudinal side surface cross sections comprise beveled angles in the range from 3 degrees to 8 degrees relative to an axis disposed perpendicular to the cutting face.

18. The downhole cutting tool of claim 16, wherein the beveled portions of the second longitudinal side surface cross sections comprise beveled angles of 5 degrees relative to the axis disposed perpendicular to the cutting face.

19. The downhole cutting tool of claim 10, wherein the first and second cutting elements further comprise bottom surfaces disposed opposite the cutting faces, first longitudinal side surfaces, second longitudinal side surfaces disposed opposite the first longitudinal side surfaces, first lateral side surfaces, second lateral side surfaces disposed opposite the first lateral side surfaces, first radial surfaces disposed between the first longitudinal side surfaces and the first lateral side surfaces, the first radial surfaces comprising first radii of curvature, second radial surfaces disposed between the first lateral side surfaces and the second longitudinal side surfaces, the second radial surfaces comprising second radii of curvature, third radial surfaces disposed between the second longitudinal side surfaces and the second lateral side surfaces, the third radial surfaces comprising third radii of curvature, and fourth radial surfaces disposed between the second lateral side surfaces and the first longitudinal side surfaces, the fourth radial surfaces comprising fourth radii of curvature.

20. The downhole cutting tool of claim 10, the downhole cutting tool further comprising at least two blades disposed on the cutting end, the first cutting element being disposed on a beveled portion of a first blade and the second cutting element being disposed on a beveled portion of a second blade, wherein the first and second blades are disposed on the cutting end so that the first and second cutting elements are disposed facing each other and at least a portion of each of the first and second cutting elements are disposed across a center point of the cutting end.

21. A cutting element for inclusion on a downhole cutting tool for cutting an object disposed in a wellbore, the cutting element comprising:

a body comprising a top surface, a bottom surface disposed opposite the top surface, a first longitudinal side surface, a second longitudinal side surface disposed opposite the first longitudinal side surface, a first lateral side surface, a second lateral side surface disposed opposite the first lateral side surface, and a central longitudinal axis defined by the top surface and the bottom surface; and a cutting profile, the cutting profile disposed asymmetrically along the top surface relative to the longitudinal axis, wherein the first and second longitudinal side surfaces provide a first longitudinal width across the top surface and a second longitudinal width across the bottom surface, the first longitudinal width being greater than the longitudinal second width.

22. A cutting element for inclusion on a downhole cutting tool for cutting an object disposed in a wellbore, the cutting element comprising:

a body comprising a top surface, a bottom surface disposed opposite the top surface, a first longitudinal side surface, a second longitudinal side surface disposed opposite the first longitudinal side surface, a first lateral side surface, a second lateral side surface disposed opposite the first lateral side surface, and a central longitudinal axis defined by the top surface and the bottom surface; and a cutting profile, the cutting profile disposed asymmetrically along the top surface relative to the longitudinal axis, wherein the first and second lateral side surfaces provide a first lateral width across the top surface and a second lateral width across the bottom surface, the first lateral width being greater than the lateral second width.

23. A cutting element for inclusion on a downhole cutting tool for cutting an object disposed in a wellbore, the cutting element comprising:

a body comprising a top surface, a bottom surface disposed opposite the top surface, a first longitudinal side surface, a second longitudinal side surface disposed opposite the first longitudinal side surface, a first lateral side surface, a second lateral side surface disposed opposite the first lateral side surface, and a central longitudinal axis defined by the top surface and the bottom surface;

a cutting profile, the cutting profile disposed asymmetrically along the top surface relative to the longitudinal axis;

a first radial surface disposed between the first longitudinal side surface and the first lateral side surface, the first radial surface comprising a first radius of curvature;

a second radial surface disposed between the first lateral side surface and the second longitudinal side surface, the second radial surface comprising a second radius of curvature;

a third radial surface disposed between the second longitudinal side surface and the second lateral side surface, the third radial surface comprising a third radius of curvature; and a fourth radial surface disposed between the second lateral side surface and the first longitudinal side surface, the fourth radial surface comprising a fourth radius of curvature, wherein the first radius of curvature is equal to the fourth radius of curvature, the second radius of curvature is equal to the third radius of curvature, and the first and fourth radii of curvature are not equal to the second and third radii of curvature.

* * * * *